US007958862B2

(12) United States Patent
Carter et al.

(10) Patent No.: US 7,958,862 B2
(45) Date of Patent: Jun. 14, 2011

(54) ROTARY POSITIVE DISPLACEMENT COMBUSTOR ENGINE

(75) Inventors: Preston Henry Carter, Bend, OR (US); Kenney Ray Spence, Bend, OR (US)

(73) Assignee: SECCO2 Engines, Inc., Pleasanton, CA (US)

( * ) Notice: Subject to any disclaimer, the term of this patent is extended or adjusted under 35 U.S.C. 154(b) by 679 days.

(21) Appl. No.: 11/999,748

(22) Filed: Dec. 7, 2007

(65) Prior Publication Data

US 2009/0148327 A1 Jun. 11, 2009

(51) Int. Cl.

| | |
|---|---|
| ***F02B 53/00*** | (2006.01) |
| ***F01C 1/04*** | (2006.01) |
| ***F01C 1/02*** | (2006.01) |
| ***F04C 18/063*** | (2006.01) |

(52) U.S. Cl. ..... 123/235; 418/55.2; 418/55.3

(58) Field of Classification Search ..... 123/235; 418/55.1–55.5

See application file for complete search history.

(56) References Cited

U.S. PATENT DOCUMENTS

| | | | | | |
|---|---|---|---|---|---|
| 801,182 | A | * | 10/1905 | Creux | 418/55.2 |
| 2,231,440 | A | | 2/1941 | Fess | 123/247 |
| 3,237,403 | A | | 3/1966 | Feher | 60/647 |
| 4,129,405 | A | | 12/1978 | McCullough | 418/55.2 |
| 4,157,234 | A | | 6/1979 | Weaver et al. | 418/55.2 |
| 4,199,308 | A | | 4/1980 | McCullough | 418/55.4 |
| 4,477,239 | A | | 10/1984 | Yoshii et al. | 418/55.2 |
| 4,490,099 | A | | 12/1984 | Terauchi et al. | 418/55.2 |
| 4,497,615 | A | | 2/1985 | Griffith | 418/55.1 |
| 4,505,651 | A | | 3/1985 | Terauchi et al. | 418/55.1 |
| 4,677,949 | A | * | 7/1987 | Youtie | 123/235 |
| 4,773,144 | A | * | 9/1988 | Youtie | 29/888.022 |
| 4,824,343 | A | | 4/1989 | Nakamura et al. | 418/55.1 |
| 4,824,345 | A | | 4/1989 | Fukuhara et al. | 418/55.2 |
| 4,927,339 | A | | 5/1990 | Riffe | 418/55.3 |
| 4,990,071 | A | * | 2/1991 | Sugimoto | 418/55.2 |
| 5,094,205 | A | * | 3/1992 | Billheimer | 123/235 |
| 5,247,795 | A | * | 9/1993 | McCullough | 418/55.3 |
| 5,293,850 | A | * | 3/1994 | Nishida | 123/235 |
| 6,220,840 | B1 | * | 4/2001 | Calhoun et al. | 418/55.2 |
| 7,124,585 | B2 | * | 10/2006 | Kim et al. | 418/55.2 |
| 7,284,363 | B2 | | 10/2007 | Kung | 60/670 |
| 2002/0148225 | A1 | | 10/2002 | Lewis | 60/670 |
| 2003/0000213 | A1 | | 1/2003 | Christensen et al. | 60/670 |
| 2007/0199323 | A1 | | 8/2007 | Yamaguchi et al. | 60/670 |
| 2009/0022613 | A1 | * | 1/2009 | Dai et al. | 418/55.2 |

* cited by examiner

*Primary Examiner* — Thai Ba Trieu
(74) *Attorney, Agent, or Firm* — Schwabe Williamson & Wyatt

(57) ABSTRACT

The present invention relates to the field of combustion engines and more specifically to a rotary positive displacement combustor engine. The device employs a scroll compressor and a scroll expander with an orbital shaft displaced between the compressor and expander supplying a means and link for compressing fluids within the scroll compressor and disposing the fluid within the scroll expander within which an ignition source is placed at strategic points within a pair of first isolated zones of the orbiting scroll expander generating a highly efficient process for capturing mechanical and thermal energy from combustion.

14 Claims, 15 Drawing Sheets

ROTARY POSITIVE DISPLACEMENT COMBUSTOR ENGINE

STATEMENT OF GOVERNMENT INTERESTS

This invention was made with Government support under contract W31P4Q-07-C-0056 awarded by the U.S. Army. The Government has certain rights in the invention.

CROSS REFERENCE TO RELATED APPLICATION

None.

BACKGROUND OF THE INVENTION

The present invention relates to the field of combustion engines and more specifically to a rotary positive displacement combustor engine. The device employs a scroll compressor and a scroll expander with an orbital shaft displaced between the compressor and expander supplying a means and link for compressing fluids within the scroll compressor and disposing the fluid within the scroll expander within which an ignition source is placed at strategic points within a pair of first isolated zones of the orbiting scroll expander generating a highly efficient process for capturing mechanical and thermal energy from combustion. The scroll expander is operating as a combustor and will herein be referred to as a combustor or scroll combustor.

This invention provides the means to implement thermodynamic power cycles that require constant, or nearly constant, volume combustion. This invention utilizes and extends the application of rotary engine device originally proposed by Leon Creux in U.S. Pat. No. 801,182, "Rotary Engine". The Creux mechanism functioned as an expander or compressor for engine applications but was limited in that the inventor envisioned and described the expander scroll utilizing a high pressure fluid (steam) introduced into the expander scroll producing mechanical energy from the orbital movement of the expander scrolls. In contrast, this invention can utilize the creation of isolated zones within the scroll expander as the location for combustion and thereby produce both mechanical and thermal energy in a device that achieves near constant volume combustion for engine applications.

The scroll design has been employed in a number of devices that require compression or expansion of fluids, from a review of the prior art material, a significant majority of the innovations have been developed for compressors and relatively few have been for expanders. One of the first attempts to exploit a scroll as an expander for combustion utilized an ignition source located at or near the central chamber of the expander scroll. See U.S. Pat. No. 4,677,949, "Scroll Type Fluid Displacement Apparatus" Youtie, Robert. In the '949 patent, the figures and description describe a compact compressor and expander utilizing a central orbital stator located within a vessel and means for orbiting the stator creating a compressor on one side of the vessel and an expander on the other side of the vessel, separated by the orbital stator. Fluid is compressed on the compressor side of the orbiting scroll with the compressed fluid passing into the expander scroll via a hole located in the face of a circular scroll plate or the rotating shaft. A fuel injector and spark are introduced to the fluid on the expander side of the orbital stator. Combustion is isolated from the compressor by means of a valve device deployed on the expander side of the orbital stator. From the drawings, description and claims of the '949, the combustion location is clearly identified to be taking place within the inner scroll chamber of the expander when the fluid is isolated from the compressor by means of a check valve. Isolating the compressor outlet by means of a check valve in the expander inlet creates several limitations or inefficiencies overcome by the present invention.

When ignition takes place within the inlet chamber of the expander in the '949 and others, the combusted fluid expands very quickly producing a sharp increase in pressure. The increased pressure maintains the check valve closed for a period in which the compressor has to work harder to overcome the pressure created by combustion on the other side of the valve face. As the orbital stator continues to rotate, the high pressure fluid in the inlet chamber is allowed to expand within the scroll expander decreasing the pressure on the valve face. Once pressure within the expander inlet chamber is reduced below the pressure of the compressor outlet, the valve will open and a new volume of clean compressed air is introduced into the inlet chamber of the expander. Even though the expander is allowing the combusted fluid to expand with the expander, residue of combusted fluid will remain in the inlet chamber of the expander with the opening of the valve. The clean air from the compressor outlet mixes with the residue of the combusted fuel and when additional fuel is injected into the inlet chamber of the expander, the fuel and air are diluted by the residual combusted material prior to ignition, reducing the efficiency of the combustion process.

In the present invention, the fuel and air mixture are first isolated from the compressor outlet by the expander walls prior to ignition. The increase pressure of the ignited fuel and air mixture produces torque (force) on the spiral walls of the orbiting expander scroll producing torque or movement of the orbiting scroll expander. The compressor does not have to overcome the pressure of the combusted fluid since it is isolated from the area or point of combustion by the orbiting scroll walls. The compressor is continuously delivering compressed fluid to the inlet chamber of the scroll expander through the hollow shaft and there are no valves or valve systems disposed between the compressor outlet and the expander inlet. The compressed fluid is continuously transferred to the expander where the orbiting expander scroll continuously isolates two separate volumes of fluid per orbit and transfers those volumes away from the intake chamber of the expander scroll prior to combustion. Thermodynamic efficiency is increased when the compressed fluid is isolated from combusted byproducts not apparent in the '949 patent.

Other means for isolating the combustion phase from the compression stage of the thermodynamic cycle are described in several other patents, see U.S. Pat. No. 5,094,205, "Scroll-Type Engine", Billheimer, James and U.S. Pat. No. 5,293,850, "Scroll Type Rotary Internal Combustion Engine", Mitsuhiro Nishida, Fukuoka. The descriptions, figures and claims associated with these two patent does not describe a means for exposing the fluid to an ignition source within the expander scroll, once isolated from the intake chamber of the scroll expander.

In the '205 the device, like the '949, uses a compact scroll design that utilizes a central orbiting plate for compression on one side and expansion on the other side. Most of the innovation described by the '205 patent involves the unique means in which the shared scroll plate is orbited within a central chamber. Fluid, once compressed by the scroll compressor is delivered to the expander side of the internal scroll plate by means of a hole placed near the center of the orbiting scroll plate—once fluid is transferred to the other side of the scroll plate (the expander side), the orbiting plate continues to rotate until a vein of the fixed plate compressor covers the hole between the compressor and expander sides of the plate, a spark is timed for igniting the fluid at this point (fixed vein covering the hole) within the inner chamber of the expander scroll and the fluid is combusted. While the '205 does not use a check valve this technique to create isolation of the compressor outlet from the combustor inlet, like the '949 patent, suffers from the same limitations described above in that the combustion in the expander generates a reverse pressure on the compressor outlet causing additional work for the compressor that has to overcome the rapidly increasing pressure in the intake chamber of the expander. Additionally, it appears that the amount of time in which the vein covers the hole disposed between the compressor and expander is insufficient for the combustion to be isolated from the compressor outlet to allow the expander to transfer the combusted mixture from the inlet of the expander. The result of timing the combustion in this manner creates a sequence is in which byproducts created from the combustion process remains in the expander intake chamber or bleeds back into the compressor outlet chamber mixing with clean noncombusted fluid from at the compressor outlet. Sequencing combustion described in the '205 causes the compressor to work more in order to overcome the pressure escalation in the expander and produces mixing of compressed fluid with combustion byproduct prior to combustion.

Another attempt at producing a constant volume combustion machine was identified in U.S. Pat. No. 5,293,850, Nishida. This particular device, like the present invention incorporated a separated scroll compressor and expander with a means for delivering the compressed fluid from the scroll compressor to the intake chamber of the expander. The Nishida design employed a common orbital means for the scroll compressor and expander and a channel (communication passage) for transferring compressed fluid from the outlet of the scroll compressor to the inlet chamber of the scroll expander with a check valve disposed between the compressor and expander within the communication passage. Once the compressed fluid was delivered to the intake chamber of the expander, a spark was timed to ignite the fluid, creating combustion within the intake chamber of the expander and keeping the check valve closed from the compressor. While the design of this machine takes advantage of the dynamic balance achieved in the present invention, the thermodynamic efficiencies are similar to the '949 and the '205 patents and suffer from the same limitations. Combusted fluid within the expander will cause the compressor to work against the closed check valve until pressure is reduced to a sufficient level by the combusted fluids being moved from the intake chamber to the isolated scroll zones within the expander. This extra work is less efficient than the present invention in which the orbital scroll plate of the compressor is assisted by the combustion of the fluid, once isolated by the spiral walls of the scroll expander eliminating any additional pressure produced by combustion for which the compressor will need to overcome. Another shortcoming of this device is the description of the check valve opening once compressor pressure overcomes the combustion pressure being reduced by the expander scroll moving the combusted fluid away from the intake chamber. It appears that this would still result in the mixing of the compressed fluid from the compressor outlet with any low pressure byproducts created during combustion still remaining or not transferred by the scroll expander in the intake chamber of the expander.

It is the objective of the present invention to create a combustion process that more closely resembles the thermodynamic cycle known as the Humphrey cycle. To achieve the efficiencies of the Humphrey cycle, the device enables continuous with positive displacement the combustion process of compressed fluid.

The Humphrey cycle is a thermodynamic process describing the maximum utilization of the Otto cycle (internal combustion engine) and the Brayton cycle (turbine combustion engine), as shown in FIG. 9*a-b*. All three cycles employ isentropic compression from point 1 to point 2. In the Otto cycle and Diesel cycle, FIG. 9*c*, this is accomplished from the piston, or rotor, compressing the working fluid adiabatically. In an Otto cycle when the piston is at or near the top of its stroke the fuel air mixture is ignited. The combustion proceeds rapidly at nearly constant volume since the piston motion is slow at the top of its stroke. With this constant volume combustion the pressure rises in proportion with the rise in temperature due to combustion. Similarly, in a Diesel cycle, when the piston is at or near the top of its stroke the fuel is injected into the combustion chamber. The high-temperature from the fluid compression causes auto-ignition of the fuel with the hot fluid (air). As the piston begins to descend and expand the hot combustion products, additional fuel is injected to sustain the pressure and temperature within the cylinder. The Diesel cycle differs from the Otto cycle in that the pressure of combustion is relatively constant since the volume is mechanically expanding during the fuel injection. In an Otto cycle the high-pressure and high-temperature is produced with nearly constant-volume combustion to expand against the piston to produce power.

The Diesel cycle does not produce higher pressures and temperatures from holding the volume constant during combustion, but expands the gas, to produce power, from the mechanical compression generated at the beginning of combustion.

In the Brayton cycle, FIG. 9*b*, a fluid is compressed to a selected pressure in which heat is added, sometimes through combustion of the fluid. The heated and compressed fluid is delivered to an expansion device so that it can produce work. A portion of this work is used to drive the continuous supply and compression of fluid to the engine, while the remainder of the work represents the net performance of work from the engine. Unlike Otto cycle and Diesel cycle engine concepts, Brayton cycle engines are able to fully expand the heated compressed fluid independent of the level of compression being applied to the incoming fluid. It is important to note that the maximum compression achieved by the heated compressed fluid is the level of compression supplied by the engine. Heating, or combustion, of the fluid is achieved at constant pressure and no pressure increase is achieved during the heating of the fluid. A limitation of the Brayton cycle is that the maximum pressure of the fluid must be mechanically provided by the engine and no pressure increase is provided from fluid heating or combustion. Because the Brayton cycle provides heating at constant pressure, rather than constant volume, more work is consumed by the continuous compression of incoming fluid than other constant volume types of engine cycles.

It is well known that the thermodynamic efficiency of the Otto and Diesel cycles is a function of the compression ratio of the engine. For a given compression ratio, Otto cycle engines are more efficient then Diesel cycle engines. Otto cycle engines tend to require fuels that have rapid burning characteristics in order to realize the advantages of constant-volume combustion. In actual practice these fuels tend to limit Otto cycle engines to lower compression ratios; therefore, high efficiency that is promised with high compression is difficult to achieve. Diesel engines use fuels that are slower burning but can be used at much higher compression ratios.

In actual practice, Diesel engines can achieve efficiency equal to or higher than Otto cycle engines because they can be operated at much higher compression ratio. This higher compression ratio makes the engine heavier which is not desirable in some applications. The additional strength and weight required of Diesel engines to operate at high compression ratios make them more expensive to build and operate. It would be desirable to produce an Otto cycle engine, which is more efficient, with fuels that can handle higher compression ratios. In practice this has not been achieved because both piston-crank and Wankel implementations of Otto cycle engines mechanically limit the duration in which combustion must occur in these engines in order to achieve proper operation. The desired fuels cannot burn as fast as these engines require and these engines cannot be adapted to allow slower combustion without significant performance penalties to the overall output of the engine.

The present invention describes another strategy for achieving constant-volume, combustion that can be implemented into a variety of engine configurations. The invention can be embodied in a configuration that implements widely used thermodynamic internal combustion power cycles like Otto, Diesel, Brayton, or Miller (a more efficient Otto cycle in which the compression cycle is assisted by keeping the intake valve open approximately 20-30% during the compression stroke). The invention can also be embodied in configurations of lesser known, yet more efficient, internal combustion power cycles like the Humphrey cycle, FIG. 9*e*, or hybrids of these cycles. The invention also allows the engine designer to adapt the combustion duration, and compression ratio, in a manner that will allow the overall engine performance to be optimized. The invention can also be embodied in configurations that are gas-generating cycles for producing hot high-pressure gas and/or thrust. Examples of gas generating cycles for which the invention can be embodied are: the Open Brayton cycle, the open Humphrey, and the Rocket cycle.

Internal combustion engines whether two-cycle or four-cycle and whether following the Otto, Diesel or Miller thermodynamic cycles, are mechanically implemented with either a piston-crank mechanism or Wankel rotor mechanism. Although these mechanisms have many proven benefits and features that enable internal combustion engines, these mechanisms also limit and restrict advancement of internal combustion engines in many ways. Piston-crank and Wankel rotor mechanisms achieve similar functions in that they perform work to compress a volume of fuel-air mixture, hold it for combustion, and then expand the combustion products to produce work.

Geometrically, the volume ratio of compression and expansion of piston-crank or Wankel type engines are somewhat equal based on the particular designs of the various mechanisms. The proportion of compression and expansion can be modified, somewhat, by timing of intake and exhaust ports; however, such adaptations compromises the displacement of fuel-air mixture available to the engine and compromises the overall compression available to the engine. The geometric balance of these mechanisms between compression and expansion limit the ability to completely expand the pressure of combustion; therefore, loss of potential work available.

The present invention does not have a geometric dependence between compression and expansion. The invention captures volumes of fuel-air mixture, initiates combustion, and slowly expands the combustion products. Any level of compression can be applied to an engine implemented with this invention because the compression of the device is achieved external and independent of the invention, or produced as a product of the work during expansion. This is typified by the fact that any level of expansion can be achieved based on the geometry and size of the combustor scroll.

Engines implemented with a piston-crank or Wankel rotor mechanism must achieve combustion during a short period of time as the particular mechanism transitions from compression to expansion of the internal volume. The rate of volume change with respect to combustion, as the mechanism transitions, is rather slow. The crank angle of both mechanisms is often used as a means of measuring duration of various phases of engine cycle events. The duration of crank-angle available for combustion in engines using these mechanisms is only about 30 degrees; that is, after the fuel-air mixture as been compressed, the mixture must be ignited and propagated across the entire mixture before the crank moves another 30 degrees. To achieve this rapid combustion, Otto and Miller cycle engines must be restricted to fuels that will burn quickly. Diesel cycle engines use a slower burning fuel and allow the inefficiencies resulting from longer combustion durations. These restrictions in fuel selection and cycle function result from the limited time available for combustion imposed by these mechanisms.

The present invention is far more adaptable. The invention can accommodate combustion of almost any duration, and since the expansion within the invention is slow, the inefficiencies from expanding combustion are minor for designs or situations that require longer combustion durations. The invention's adaptability and insensitivity towards longer combustion durations removes the design restrictions imposed by piston-crank and Wankel rotor mechanisms. The invention will enable the engine designer to optimize the engine cycle to the combustion duration for the fuels of interest.

Engines implemented with piston-crank and Wankel rotor mechanism are somewhat limited in that both suffer from a conflict between achieving maximum performance and achieving regulated emission quality. The limited combustion duration available to engines using these mechanisms require the temperature of combustion to be increased in order to complete combustion in the time available. Often to achieve maximum power and efficiency, the temperature of combustion must be raised to a level that compromises the quality of emissions. This conflict is a direct result of the constraints imposed by these mechanisms upon the engine design. The fact that the invention is adaptable and insensitive to combustion duration allows combustion temperatures to remain at a rate that can meet or exceed required emission quality.

Piston-crank and Wankel rotor mechanisms are not physically balanced mechanisms in terms of inertial distribution of mass and moments during operation causing a significant amount of vibration and noise. Although much technology has been applied to counter-balance and minimize the vibration of these mechanisms in operation, these mechanisms can't be perfectly balanced. Vibration is a well known problem with engines using these mechanisms. Much weight and complexity of design is required to achieve reliable engines.

In the present invention balance is easily achieved through the use of orbiting scrolls. In one embodiment of the design, the combusting scroll is balanced with an integrated scroll located in the compressor—both scrolls operate in a manner that permits the machine to be more dynamically balanced than piston-crank or Wankel rotor designs. This feature makes the invention suitable for many applications that are negatively affected by the vibration of traditional engines.

BRIEF SUMMARY OF THE INVENTION

The rotary positive displacement combustor engine is comprised of a scroll compressor and a scroll combustor with an orbital scroll plate within said compressor and combustor attached to a hollow shaft disposed between said compressor and said expander. The hollow shaft is restricted in its travel to an orbital action—providing the means for compressing a fluid introduced into a compressor intake port. As the hollow shaft is orbited, fluid is compressed in the compressor scrolls transferring the fluid from the scroll spiral peripheral toward the innermost chamber of the compressor scroll where the compressed fluid then passes through a conduit in the orbital compressor scroll plate into the orbiting hollow shaft. As the shaft continues to orbit the fluid is delivered to the innermost chamber of the expander scroll which has a conduit in the center of the expander scroll plate which is connected to the hollow shaft. Once the compressed fluid is deposited into the inlet chamber of the expander scroll, the fluid is then transferred to separate zones of the expander scroll as the expander scroll is orbited. When the expander scroll plate is orbited, a fix scroll spiral and an orbiting scroll spiral are engaged in such a manner as to create two separate and isolated scroll zones through each orbit of the orbiting scroll plate. The two zones, once isolated from the combustor inlet chamber, continue to expand in volume as the orbiting scroll plate continues to orbit. An ignition source is strategically placed in the two isolated scroll zones allowing combustible fluids to ignite and either deflagrate or detonate, creating an increase in pressure and temperature and producing a torque on the scroll spiral walls which is translated to the hollow shaft. The combusted fluid continues to expand during the orbit of the combustor scroll, eventually depositing the combusted fluid out an exhaust port. By manipulating the size and shape of the scroll, the fluid composition and point of ignition, the scroll expander is able to produce a plethora of effects (results) with respect to work done on the hollow shaft or the composition of the combusted fluid, for instance; producing either a low pressure hot fluid or high pressure hot fluid, which allows the device to be used in a wide variety of applications.

It is the objective of the rotary positive displacement combustor engine to achieve a highly efficient engine that captures work comparable to the Humphrey cycle by means of compressing and isolating a fluid (fuel and air mixture) and once isolated, expose the fluid to an ignition source and exploit the subsequent combustion to capture the greatest amount of work.

It is the objective of the rotary positive displacement combustor engine to create a highly efficient engine that; operates in a device that is dynamically balanced, can be adapted to a variety of fuel types, can be easily modified to alter the combustion duration and compression ratio in a manner that will allow the overall engine performance to be optimized for gas-generating cycles for producing hot high-pressure gas (thrust) or shaft power.

DETAILED DESCRIPTION OF THE INVENTION

Figure 1A:
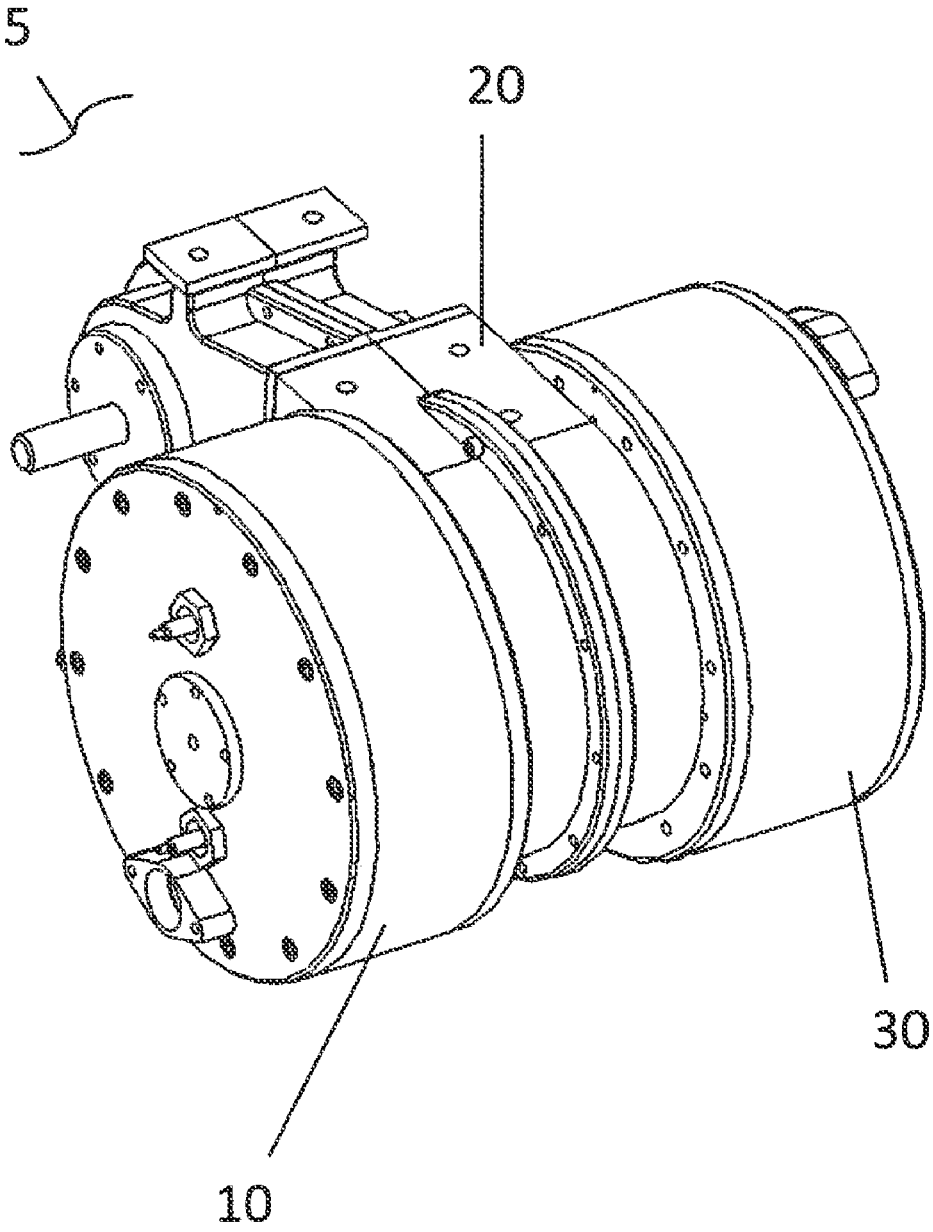
FIGS. 1*a*-1*b* respectively provide a perspective view and a sectional side view the rotary positive displacement combustor engine.

The Figures and the description of the machine and its operation include those components and processes necessary for understanding how the engine functions and does not include every possible configuration or operation that could be deployed and would be readily understood by those skilled in the art.

For the purpose of explaining how the rotary positive displacement combustor engine operates, reference will be made to FIGS. 1-8. FIG. 1*b* shows a cross section side view of the rotary positive displacement combustor engine 5, with the major components of the engine arranged as follows; a combustor assembly 10, an orbiting shaft assembly 20, a compressor assembly 30 and a set of orbiting thrust bearings 90.

The operation of the device begins with the compressor assembly 30 producing a compressed fluid and delivering the compressed fluid through the orbiting shaft assembly 20 to the combustor assembly 10. The fluid, typically air or an air and fuel mixture are introduced to a compressor intake port 32, seen on FIG. 2, located in a compressor head plate 33. In one embodiment of the device, a carburetor 39 can be attached to the compressor intake port and provide a means for delivering the fuel and air mix to the compressor assembly 30. After the fluid has been introduced through the intake port 32, the fluid is situated within an intake annulus 31, which is located within a vessel created by a compressor spool 35 and the head plate 33.

Once the fluid is deposited within the annulus 31 in which a pair of compressor scrolls are located, the fluid is available for compression by the compressor scrolls 34 and 38. A fixed scroll plate 34 is attached to the compressor head plate 33 and has a spiral band 81 axially mounted to the face of the plate projecting in toward the orbiting scroll plate, the spiral band is shaped as an involute curve on the plate face as can be seen on FIG. 5. The orbiting scroll plate 38 has a spiral band 82 axially mounted to its face and the spiral is configured counter or reversed from the spiral band 81 affixed to the fixed scroll plate 34 such that when the orbiting scroll plate 38 and fixed scroll plate 34 are engaged, the spiral bands of the fixed and orbiting scroll plate contact each other at several points along the length of the bands creating several crescent shaped zones, like zones 83 and 84 within the pair of spiral bands. The number or contact points between the orbital scroll 82 and the fixed scroll 81 are a function of the length of the spiral band and the size of the scroll compressor. The result of integrating the fixed and orbital scroll plates is a scroll compressor 86. In order for the scroll compressor to achieve fluid compression, the integrated spiral bands must be able to isolate one or more volumes of fluid at the periphery of the spiral bands from the annulus 31 of the compressor assembly 30 then transfer the volumes radially inward during the orbital motion of the scrolls and depositing the compressed fluid into a compressor outlet chamber 85 situated within the middle of the scroll compressor, as depicted in FIG. 5.

Figure 5:
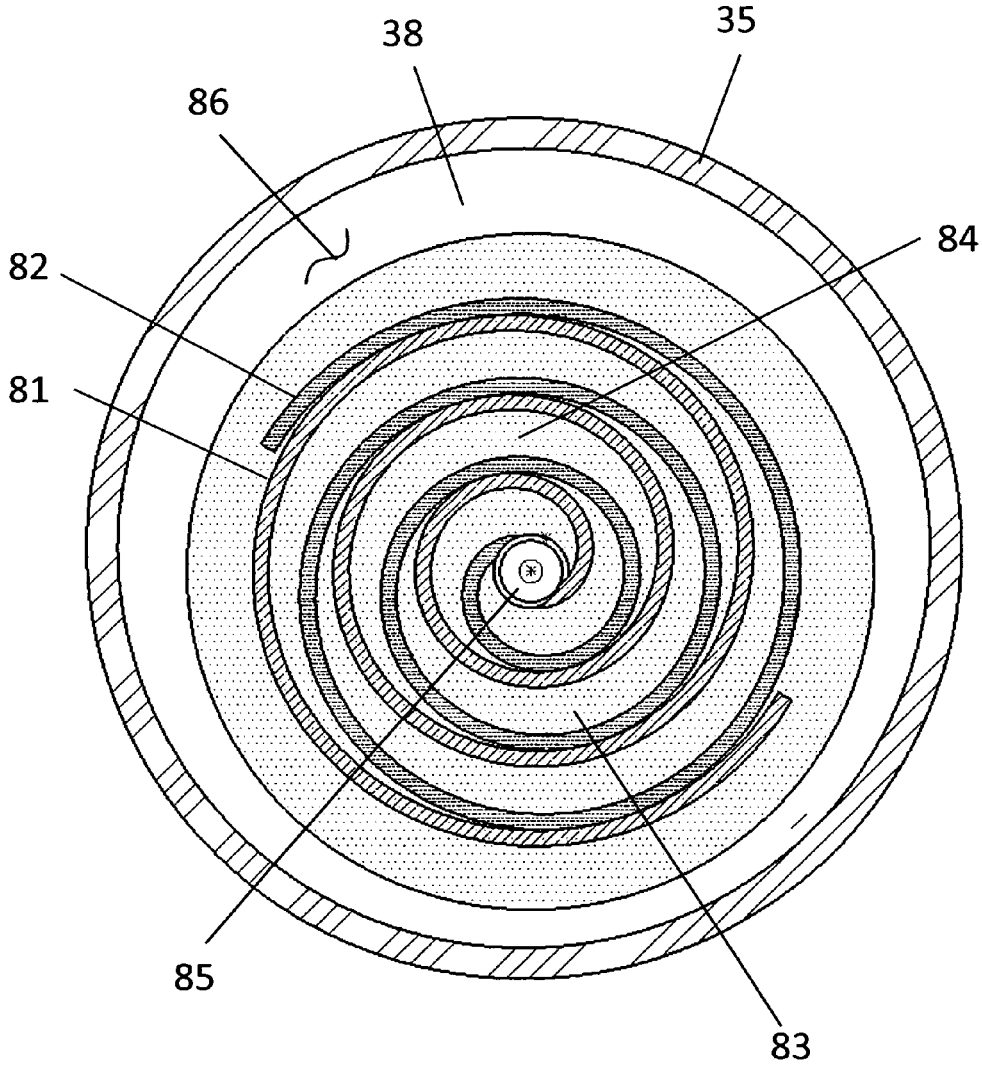
FIG. 5 is a sectional end view of the scroll compressor taken along line 5-5 of FIG. 2.
Figure 6:
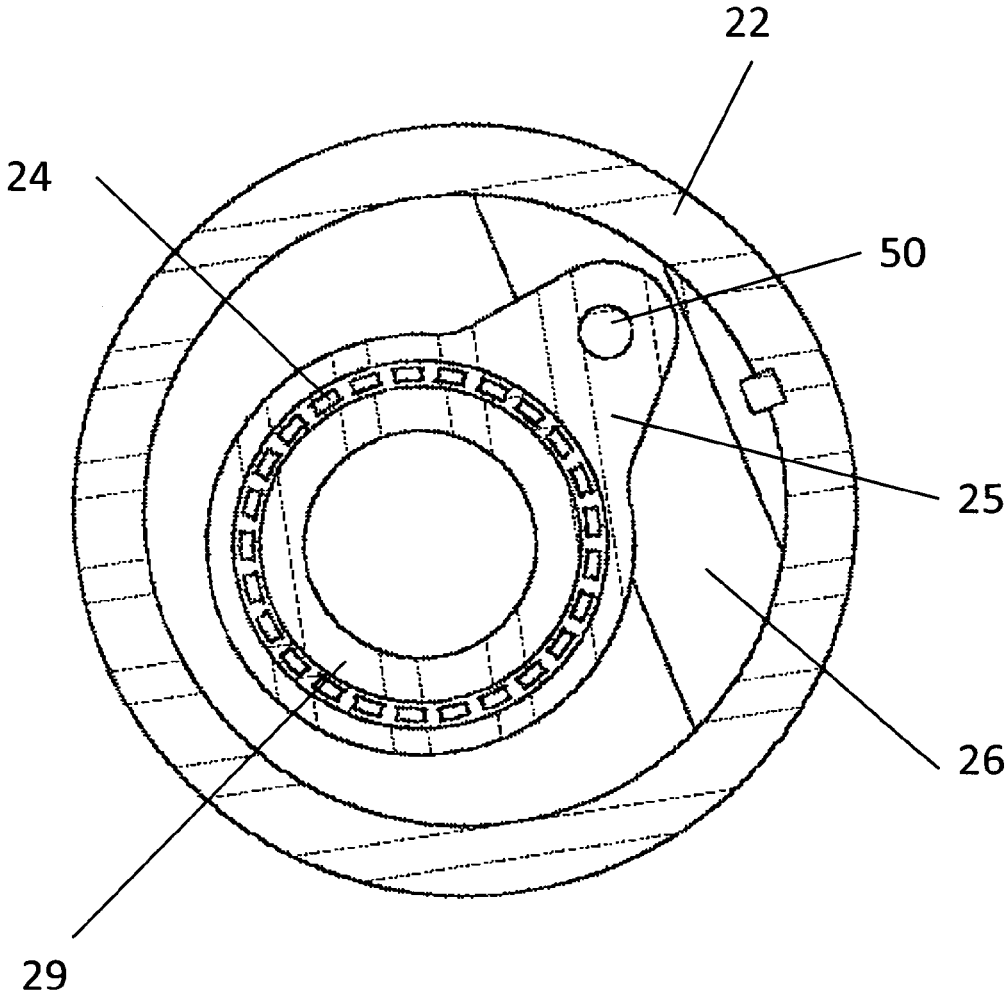
FIG. 6 is a sectional end view of the orbital shaft taken along line 6-6 of FIG. 4.

As the orbiting scroll plate 38 is rotated or orbited with respect to the fixed scroll plate 34 in the direction shown in FIG. 5, the crescent shaped zones 83 and 84 will move radially inward and decrease in size as the scroll orbits. Fluid located at the periphery of the orbital zones is captured and compressed as orbital scroll plate orbits and the crescent shaped zones shrinks and is transposed to the center of the scroll compressor. This shrinkage of volume creates fluid compression. The compressed fluid is deposited into the compressor outlet chamber 85 at the center of the compressor.

Figure 4:
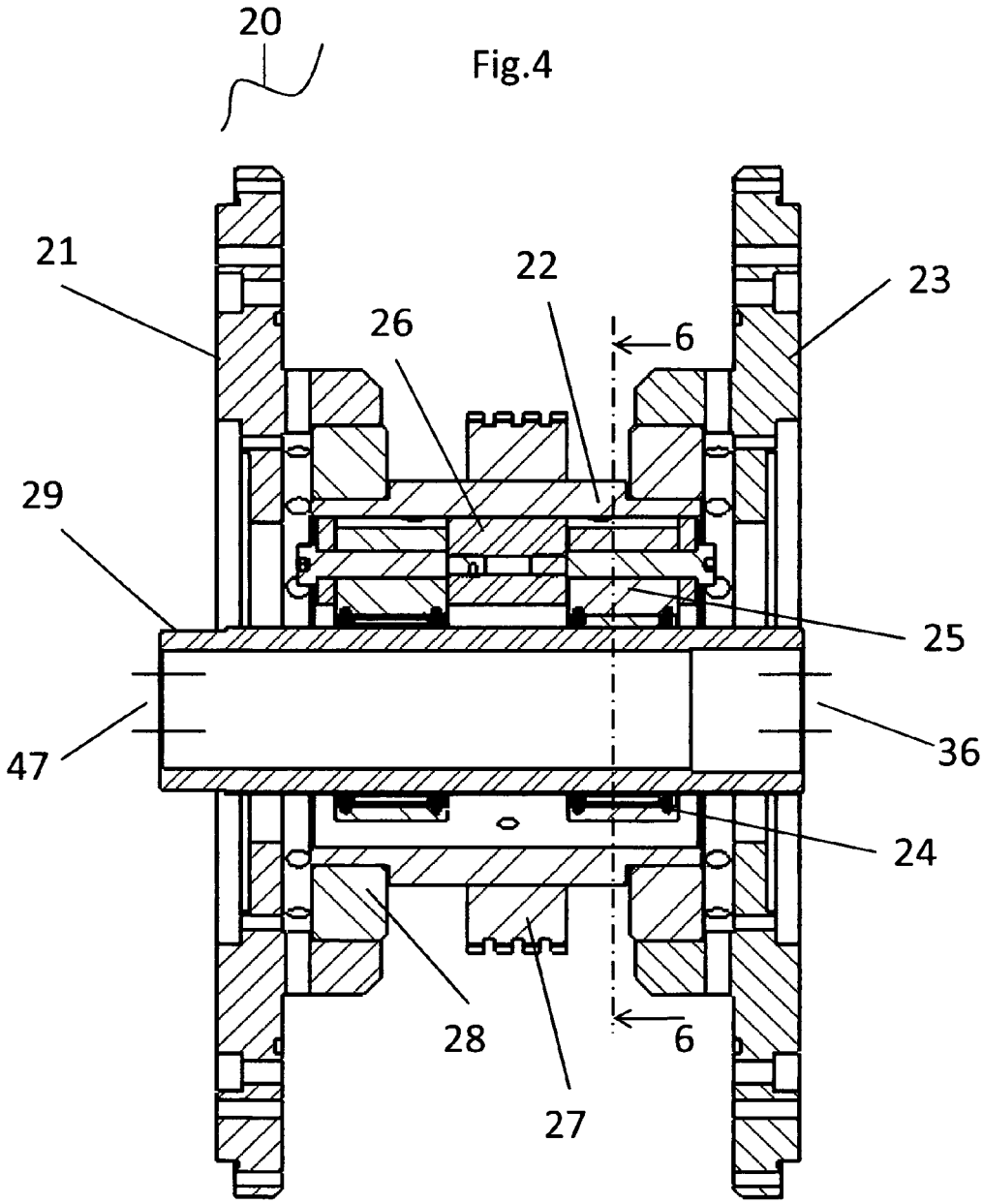
FIG. 4 is a sectional side view of the orbital shaft assembly.

From FIG. 4, the compressed fluid is then transferred to an orbital shaft 29 via compressor exhaust port 36. Fluid transfer is produced by the compression of the fluid within the scroll compressor 86 making the compressor function like a pump. The compressor exhaust 36 port is a conduit located at the center of the orbital scroll plate 37 and allows for communication between the compressor outlet chamber 85 with the orbital shaft 29. The orbital shaft 29 is constructed with a channel that allows fluid to be communicated from the compressor assembly 30 to the combustor assembly 10. One end of the orbital shaft is connected to the orbital scroll plate 38 on the compressor and the other end is attached to an orbital scroll plate 13 of the combustor.

The orbital shaft 29 is located within a barrel shaft 22 that is supported by a set of barrel shaft bearings 28. An internal counterweight 26 is fixed within the barrel shaft 22 as seen on FIG. 6. The orbital shaft 29 is connected to the internal counterweight 26 by means of an orbital link 25 and link pin 50. Needle bearings 24 support the orbital shaft within the orbital link 25. As the barrel shaft 22 is rotated, the displacement of the orbital shaft 29 is a circular movement of translation within the barrel shaft 22. This circular movement will be translated to the orbital scroll plates 38 and 13 of the compressor and the combustor creating the orbital movement of the respective scroll plates.

The particular design of the orbital shaft assembly 20 is able to take advantage of the torque created within the combustor assembly when combustion occurs allowing the high pressure created during combustion to be translated into torque on the orbital shaft which in turn creates a tighter more compliant (radial) seal within the scroll assemblies.

To initiate the combustion process, the hollow shaft is attached to a small motor that provides the initial motive force to create the orbital rotation of the hollow shaft. The small motor provide the means for creating this initial movement or orbital rotation and when the scroll combustor begins to combust, the torque created upon the hollow shaft will generate any necessary force for continued orbital rotation of the hollow shaft and the integrated compressor. Another method for initiating the orbital motion includes introduction of high pressure air or gas into one of several points within the integrated machine that creates orbital rotation within the scroll combustor (now working as an expander as Creux envisioned), creating the initial orbital rotation to start the engine. Again, once the engine is combusting, the orbital rotation will be generated from the combustion in the scroll combustor creating torque on the hollow shaft.

Figure 1B:
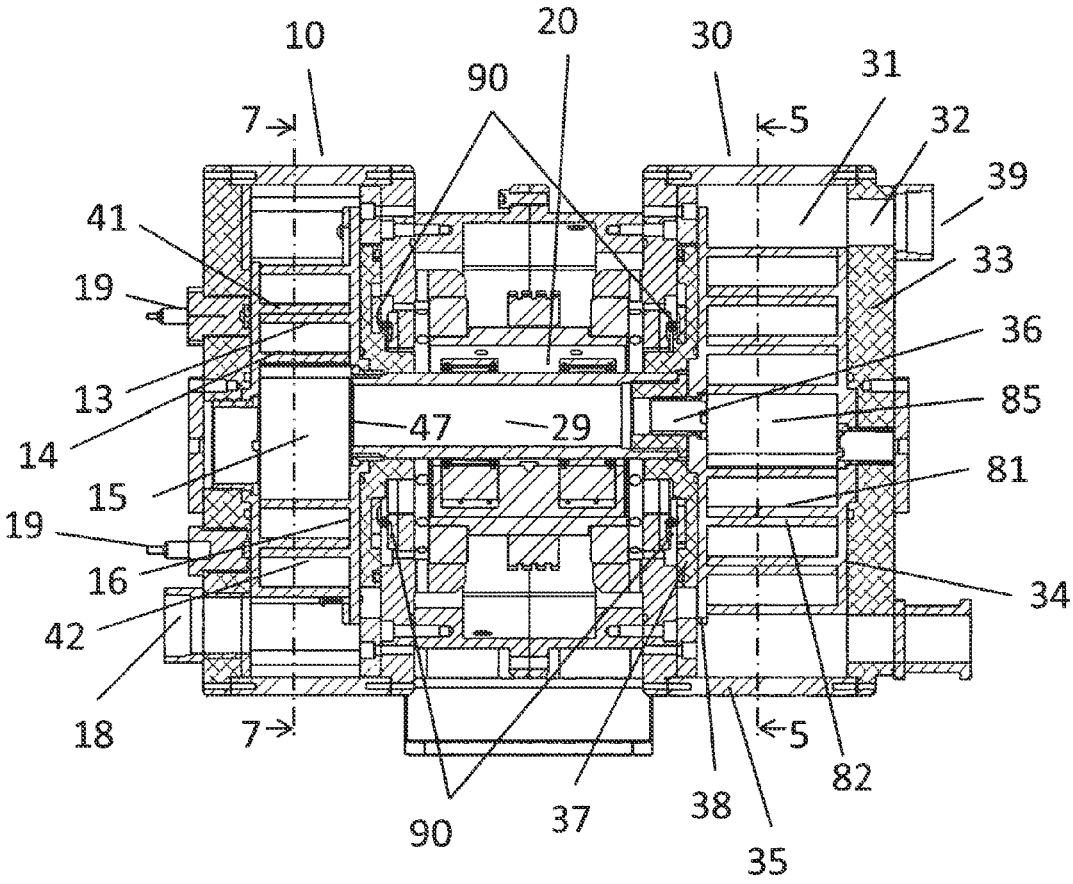
Figure 2:
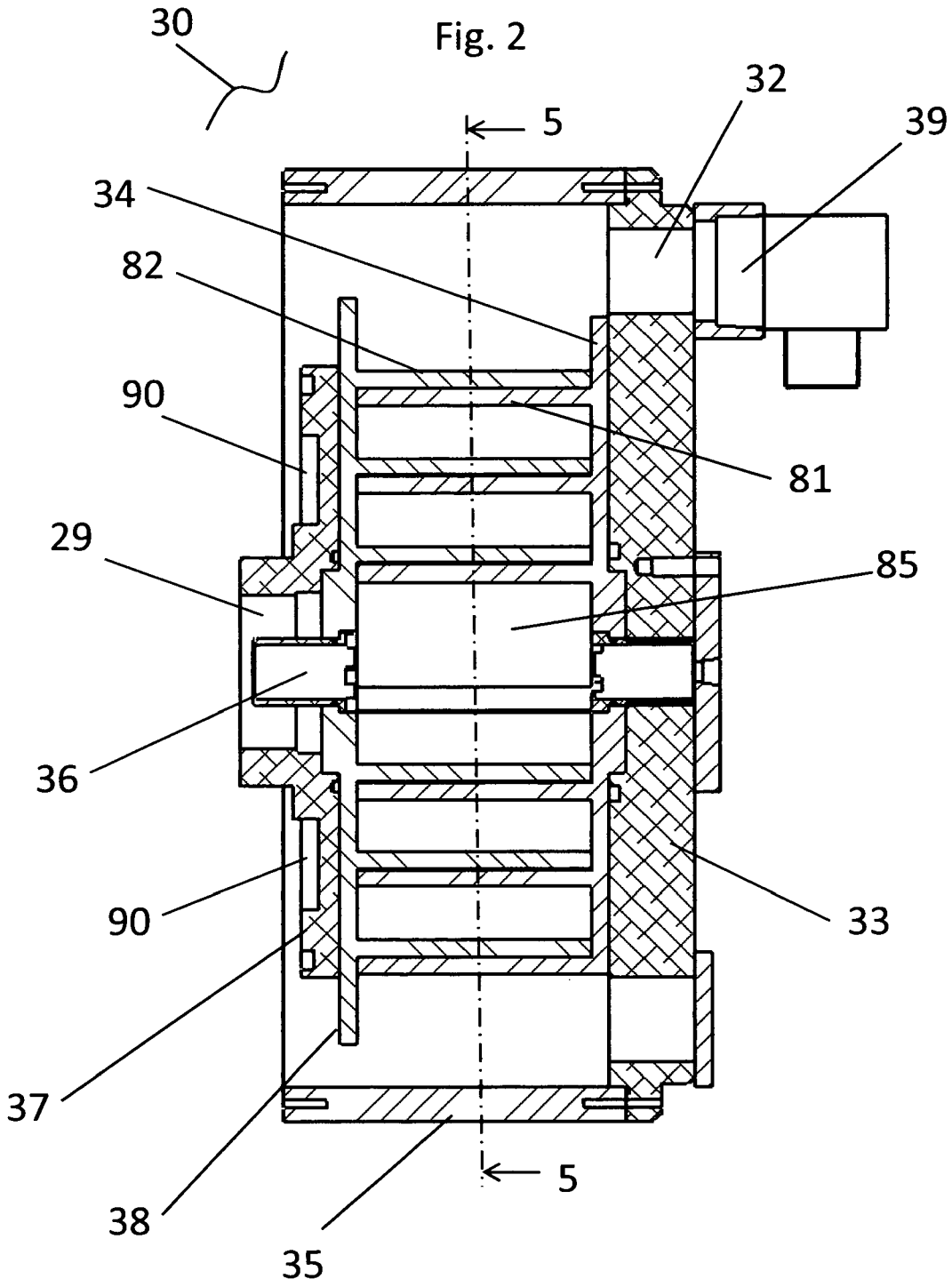
FIG. 2 is a sectional side view of the compressor assembly.

Another feature of the rotary positive displacement combustion engine is the placement of a pair of orbital thrust bearings 90, seen in FIG. 1*a* that restricts the movement of the orbital face plates of the compressor and combustor to an orbital movement of translation, preventing the plates from rotating, and provide a means for absorbing the thrust generated within the compressor and combustor during operation.

When the compressed fluid enters the orbital shaft 29, there are no valves or obstructions and therefore the compressed fluid readily passes into a combustor intake chamber 15 via an intake port 47 located at the center of an orbital scroll plate 13 which is attached to the orbital scroll pad 16 as can be seen on FIG. 1*a*.

The scroll combustor operates similar to an expander in that compressed fluid that is delivered to the intake chamber 15 is transferred radially out toward the periphery of the orbital and fixed scroll plates 13 and 14 by the orbital motion of the two integrated scrolls of the fixed and orbiting scroll plates allowing for the expansion of the fluid within the ever increasing volume of the crescent shaped zones of the scroll combustor. From FIG. 3, the combustor assembly 10 consists of the orbital scroll plate 13 fixed to the orbital scroll pad 16, and a fixed scroll plate 14 attached to a combustor head plate 11, with the fixed and orbital scrolls engaged as shown on FIG. 3. The orbital and fixed scrolls of the combustor forming a scroll combustor 43 which resides within a housing created by fastening a combustor spool 12 and the combustor head plate 11 together. The scroll combustor 43 sits within the housing forming an exhaust annulus 17 around the scroll combustor with an exhaust port 18 located in the combustor head plate 11. One or more spark plugs 19 or other similar means of ignition are located within the combustor head plate 11 and provides a means for igniting the fluid within one or more isolated zones of the scroll combustor 43.

When compressed fluid enters the intake chamber 15, the orbital scrolls of the combustor partition portions of the compressed fluid in a reverse process from the scroll compressor 86. More specifically, and as can be seen in the series of figures FIGS. 7*a-e*, starting with FIG. 7*a* the orbiting scroll plate 13 on the combustor has a spiral band 42 axially mounted to the face of the orbital scroll plate and projecting in toward the fixed scroll plate 14, the spiral band is shaped as an involute curve on the plate face as can be seen on FIG. 7*a*. The fixed scroll plate 14 has a spiral band 41 axially mounted to its face and the spiral is configured counter or reversed from the orbital scroll plate band 42 such that when the orbiting scroll plate 13 and fixed scroll plate 14 are engaged, the spiral bands of the fixed and orbiting scroll plate contact each other at several points along the length of the bands creating several crescent shaped zones 45 and 46 within the pair of spiral bands, as can be seen on FIG. 7*c*.

Figure 7A:
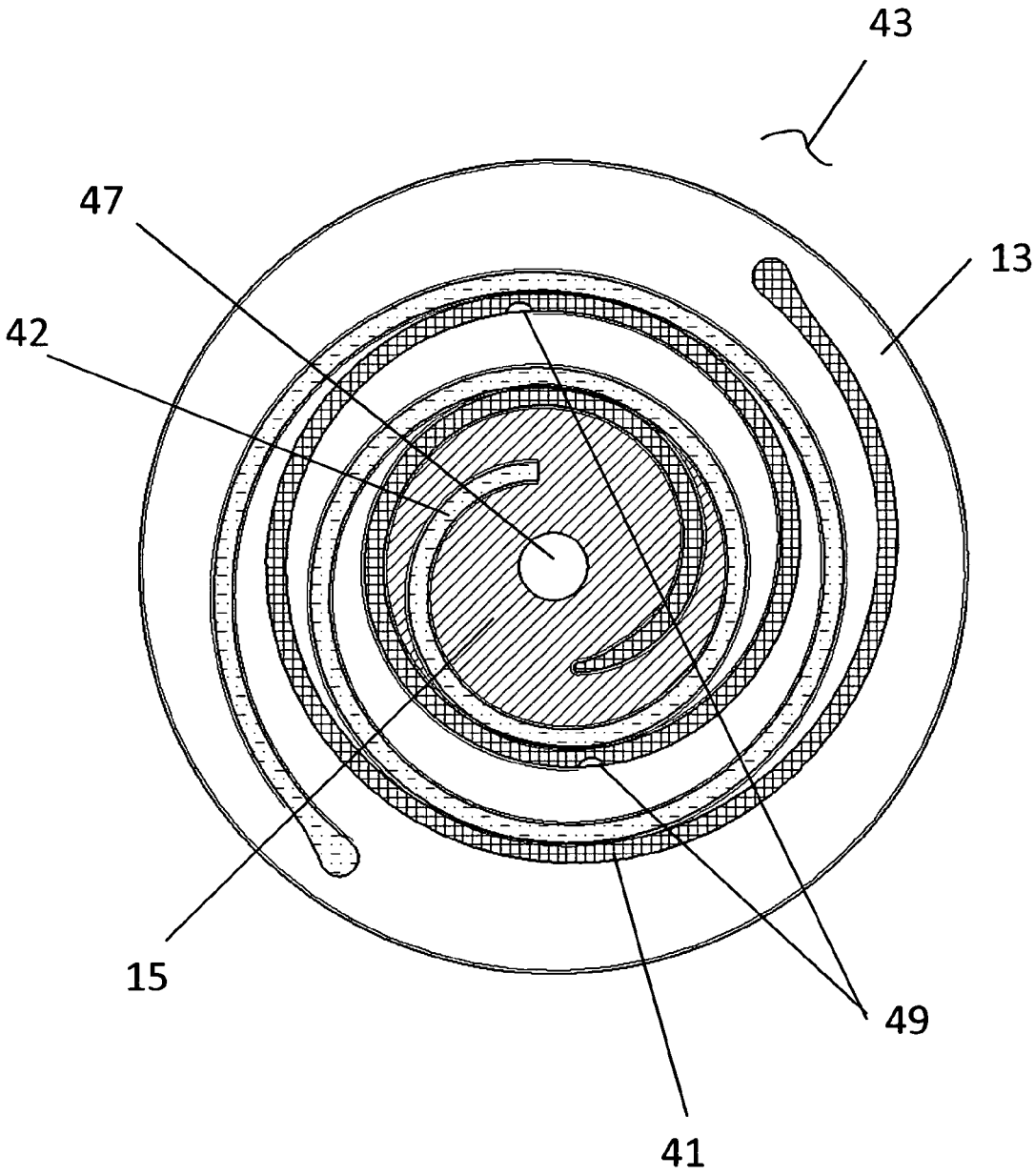
FIG. 7*a-e* is a series of sectional end views of the scroll combustor taken along line 7-7 of FIG. 3, showing the various stages of fluid movement within the scroll combustor during one orbit.
Figure 7B:
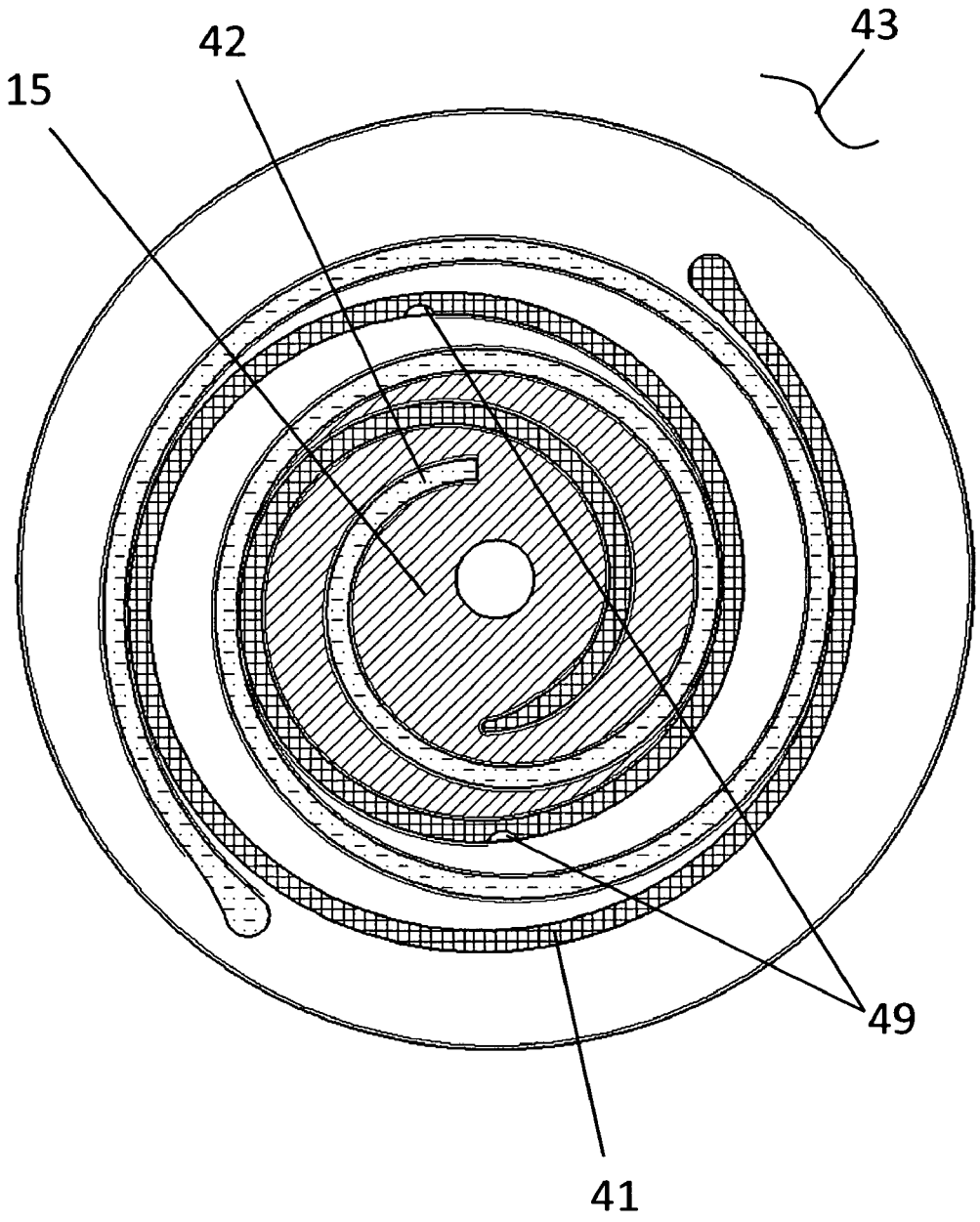
Figure 7C:
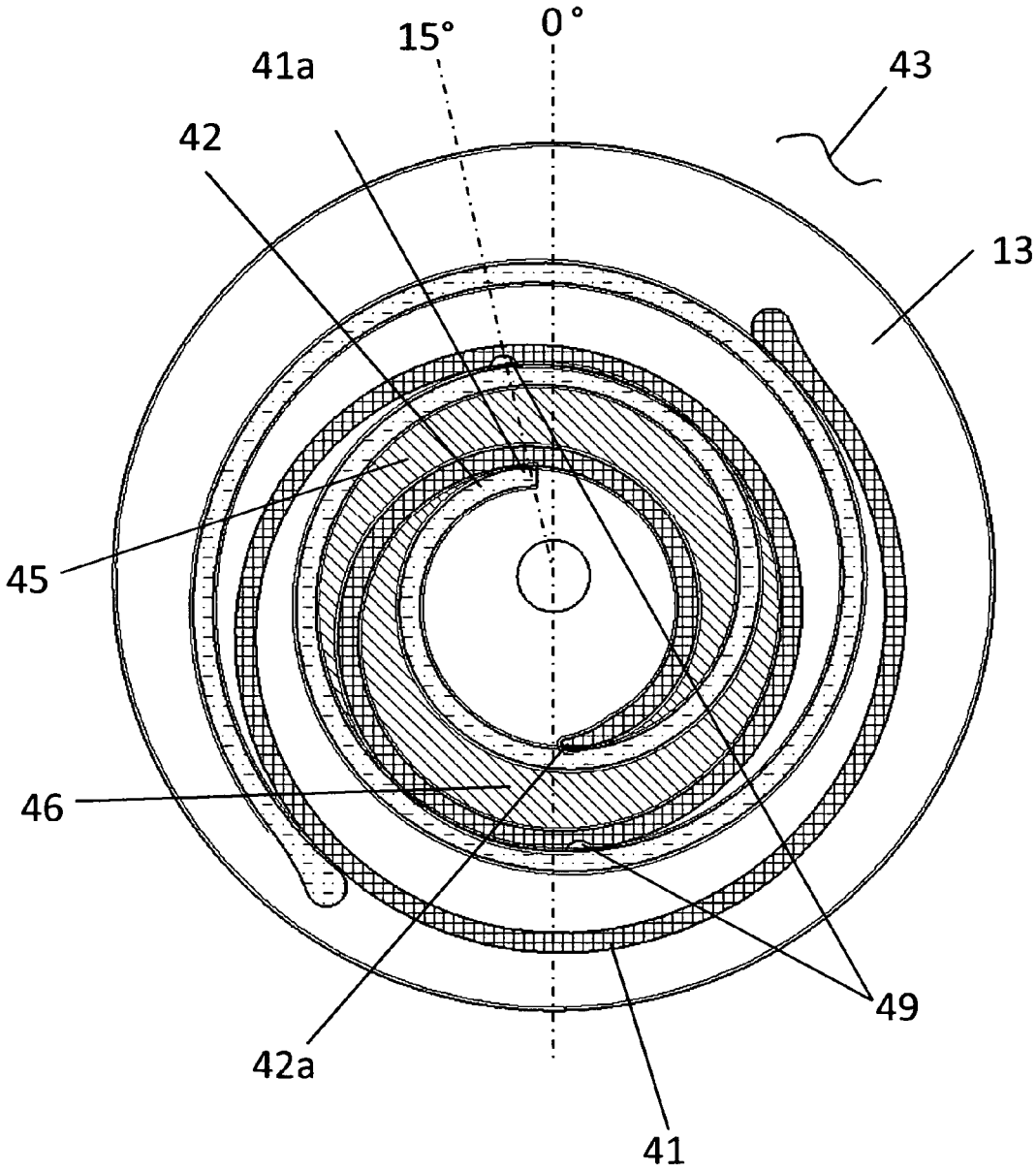

To describe the combustion process within a scroll combustor 43, refer thereto FIGS. 7*a-e*, when the compressed fluid is introduced into the scroll combustor, as depicted by the diagonal hatch lines in FIG. 7*a*, the fluid occupies the intake chamber 15 and surrounds the innermost portions of the spiral bands 41 and 42 of the orbital and fixed scroll plates, with the contact points between the fixed and orbital spiral bands 41 and 42 providing a means for separating and isolating the incoming fluid from the radially outward moving crescent shaped zones 45 and 46 as seen in FIG. 7*c*. As the orbital scroll plates is displaced in a circular movement of translation with respect to the fixed scroll plate, the spiral bands are moved with respect to each other enabling the compressed fluid to fill the void created by the expanding volume created by the spiral bands moving the contact point between them radially outward with the orbital motion of the plates, FIGS. 7*a*-7*e*. As the orbital motion continues, the innermost points 41*a* and 42*a* of the orbiting and fixed spiral bands 41 and 42 respectively make contact with the wall of the opposite member 42 and 41 respectively at some point radially along the spiral band consequently creating a pair of crescent shaped zones 45 and 46 within the scroll combustor as can be seen on FIG. 7*c*. The crescent shaped zones 45 and 46 once isolated from the intake chamber 15 of the scroll combustor 43 continue to expand radially outward toward an exhaust annulus 17.

Figure 3:
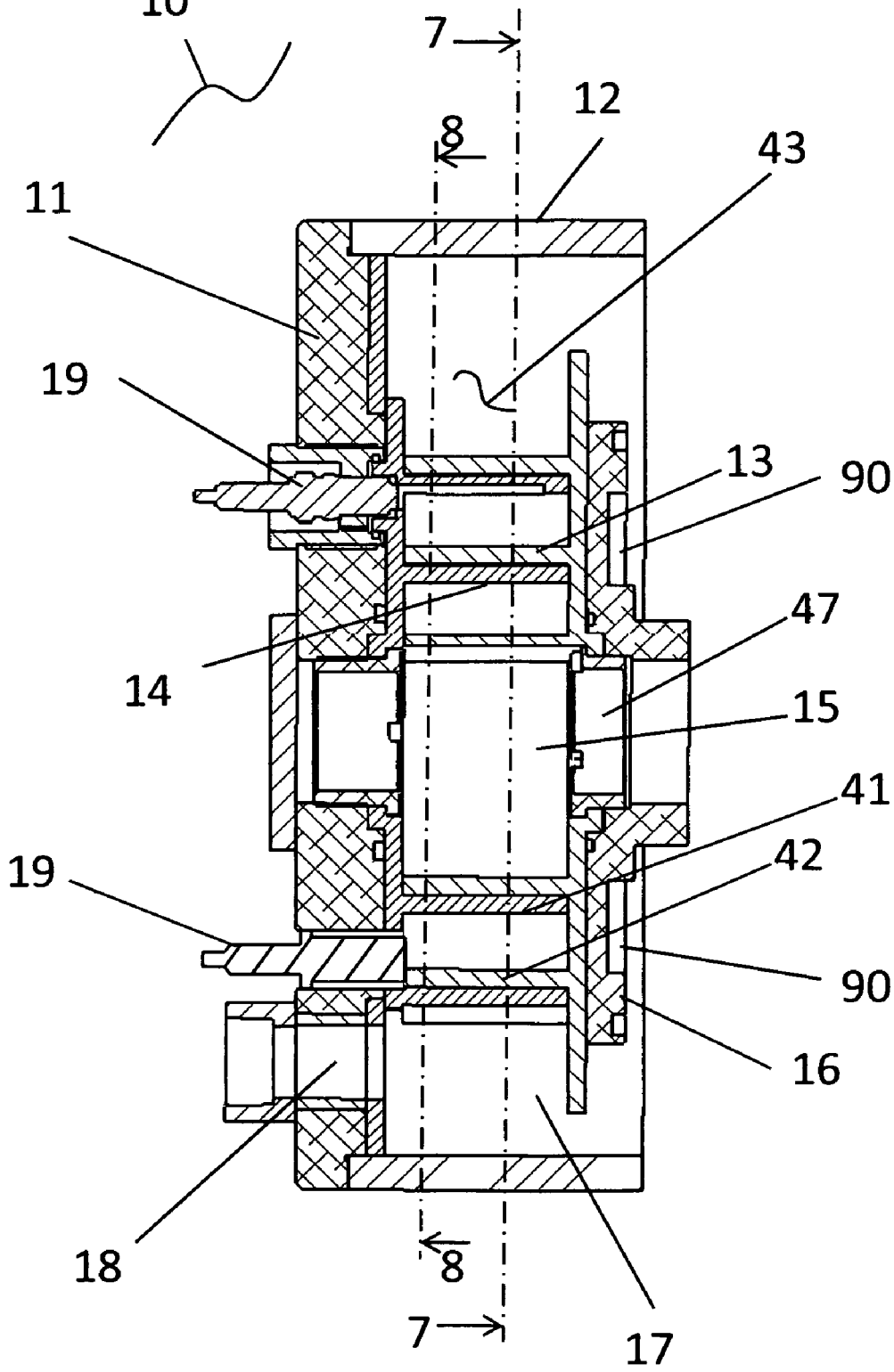
FIG. 3 is a sectional side view of the combustor assembly.
Figure 7D:
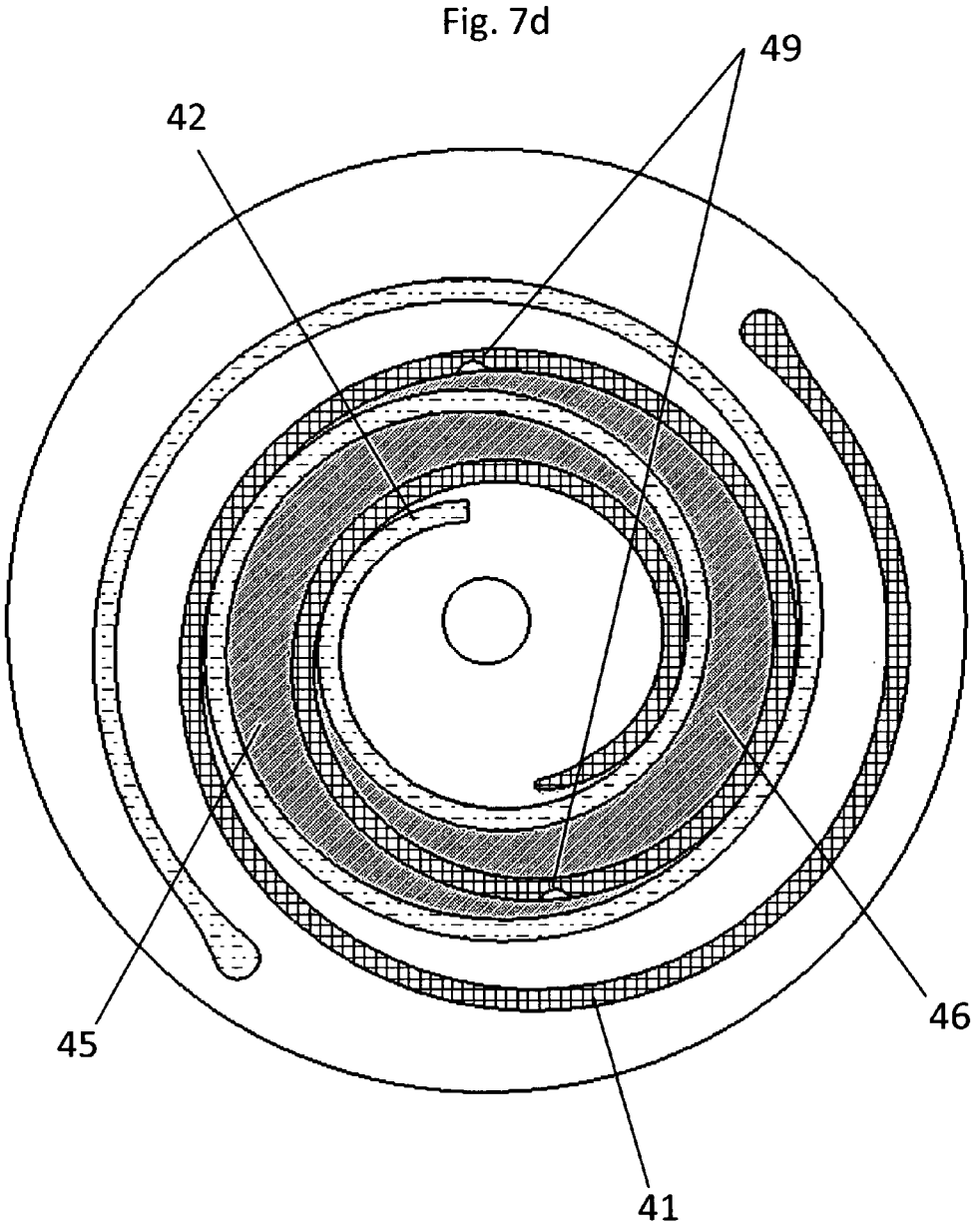
Figure 7E:
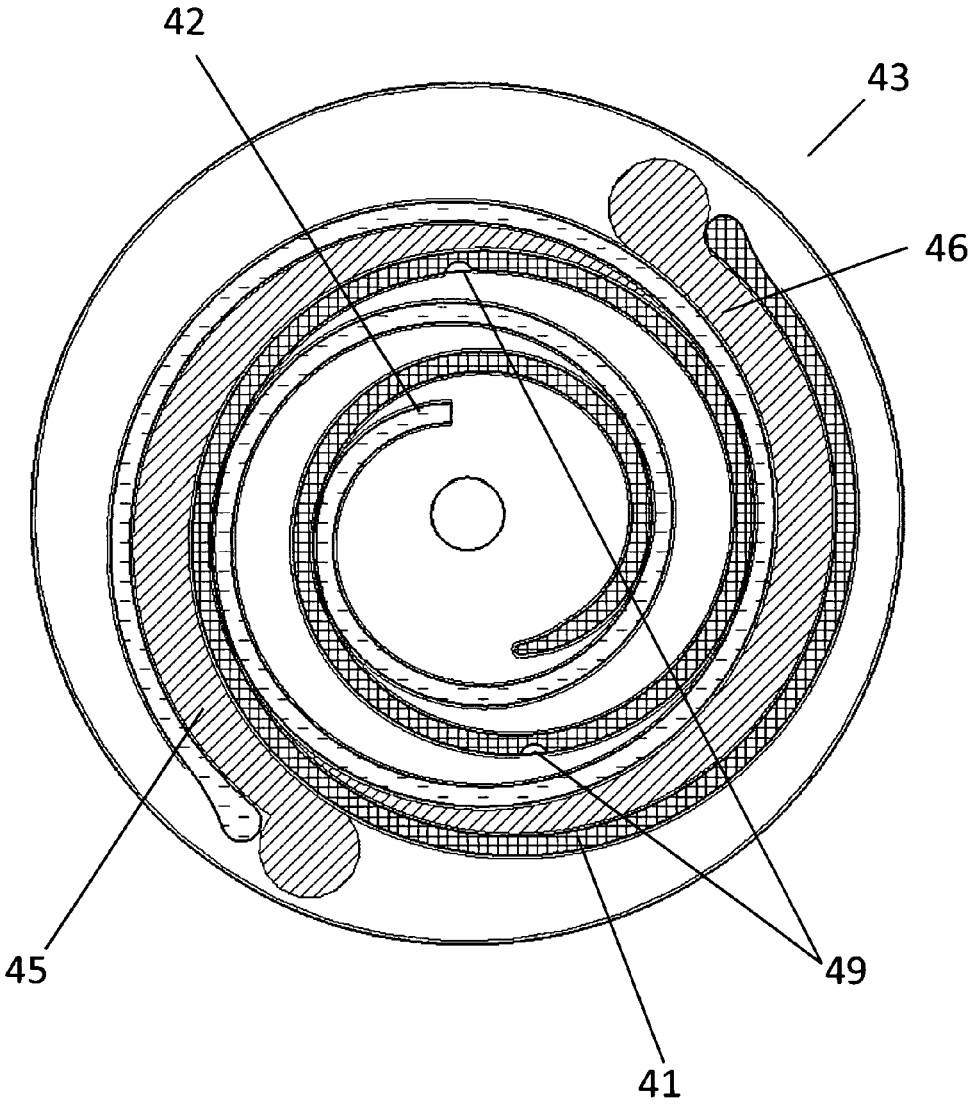
Figure 8:
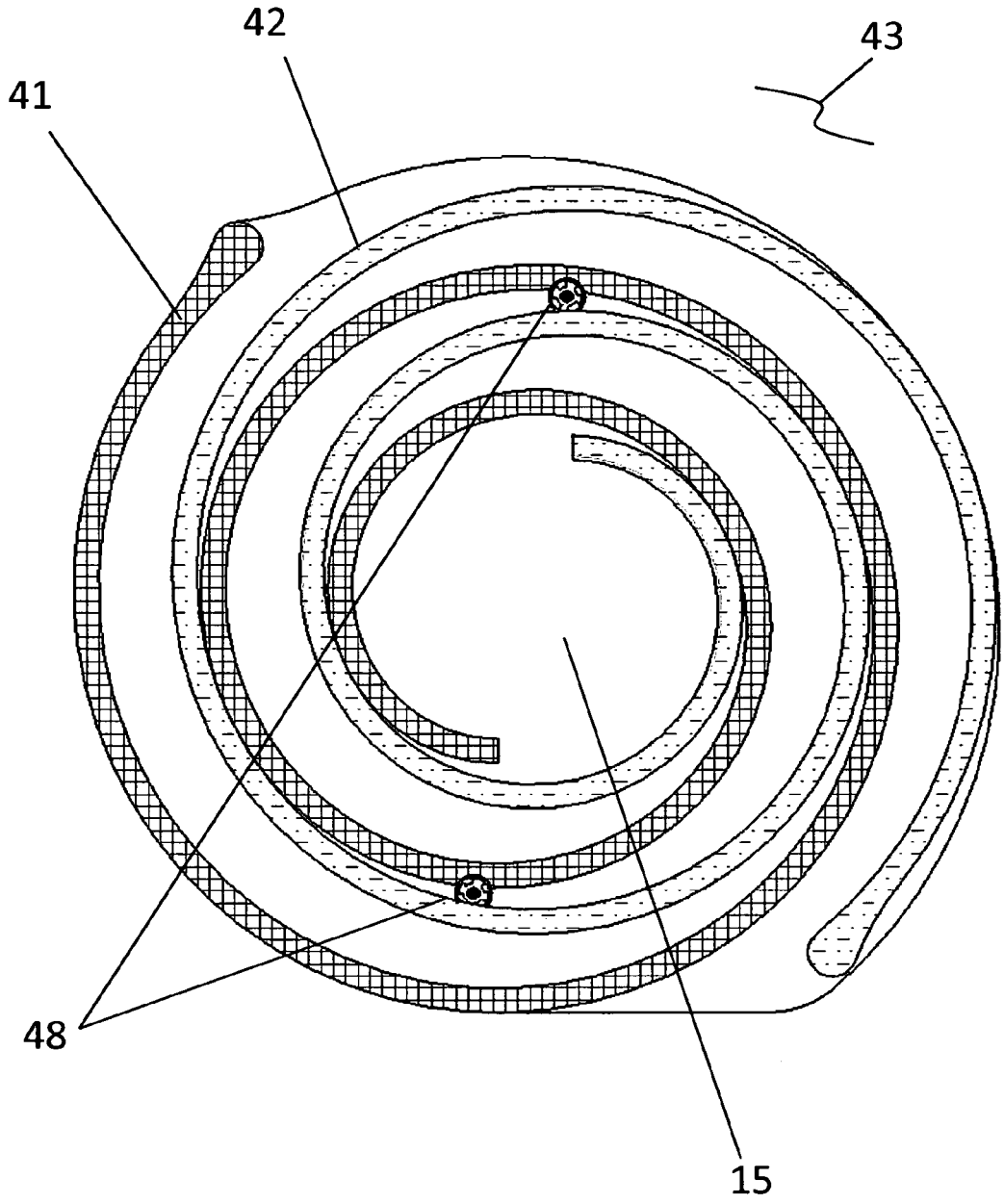
FIG. 8 is a sectional end view of the scroll combustor taken along line 8-8 of FIG. 3.
Figure 9A:
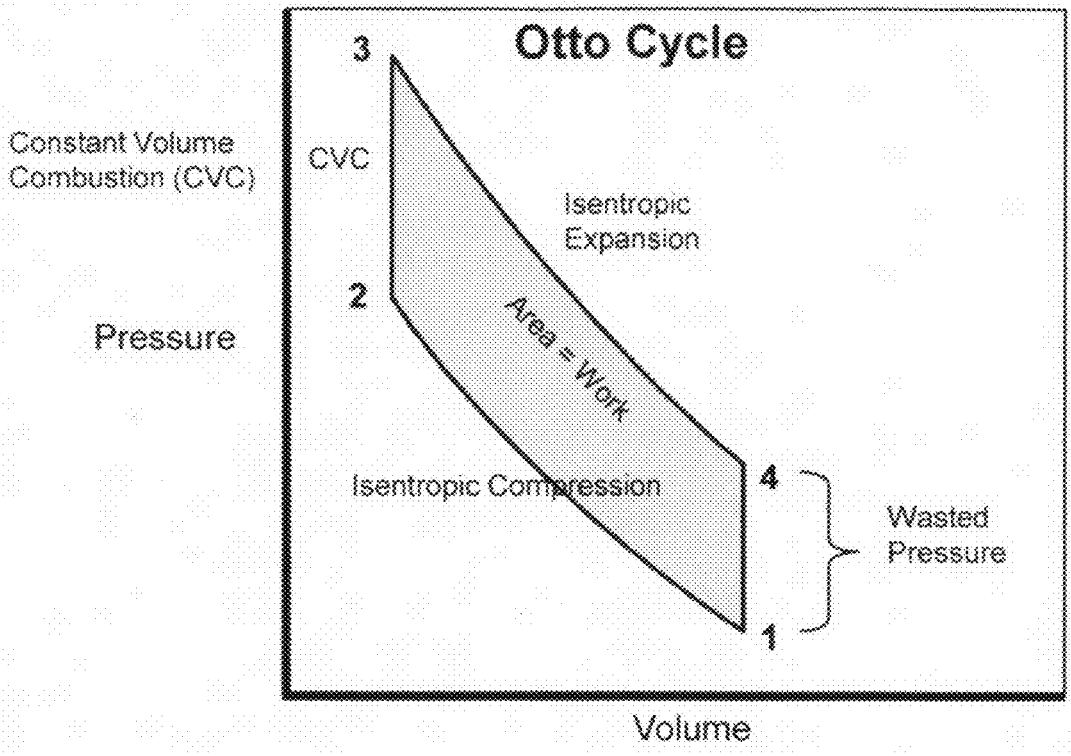
FIGS. 9*a* through 9*d* are diagrams of the various thermodynamic cycles showing work output from changes in pressure and volume.
Figure 9B:
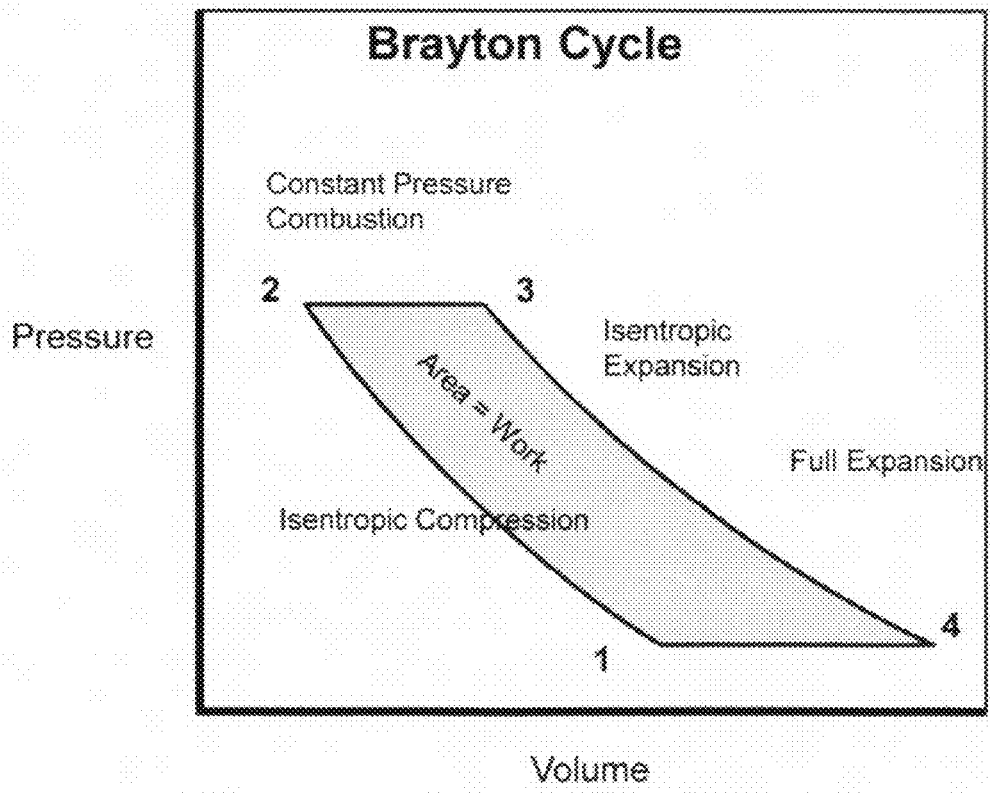
Figure 9C:
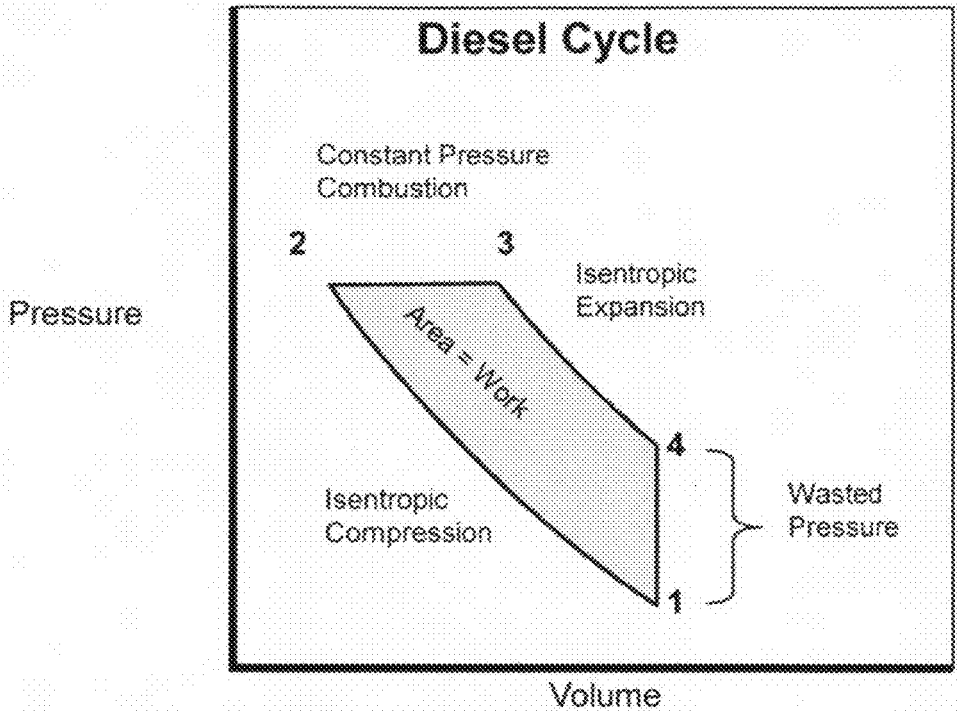
Figure 9D:
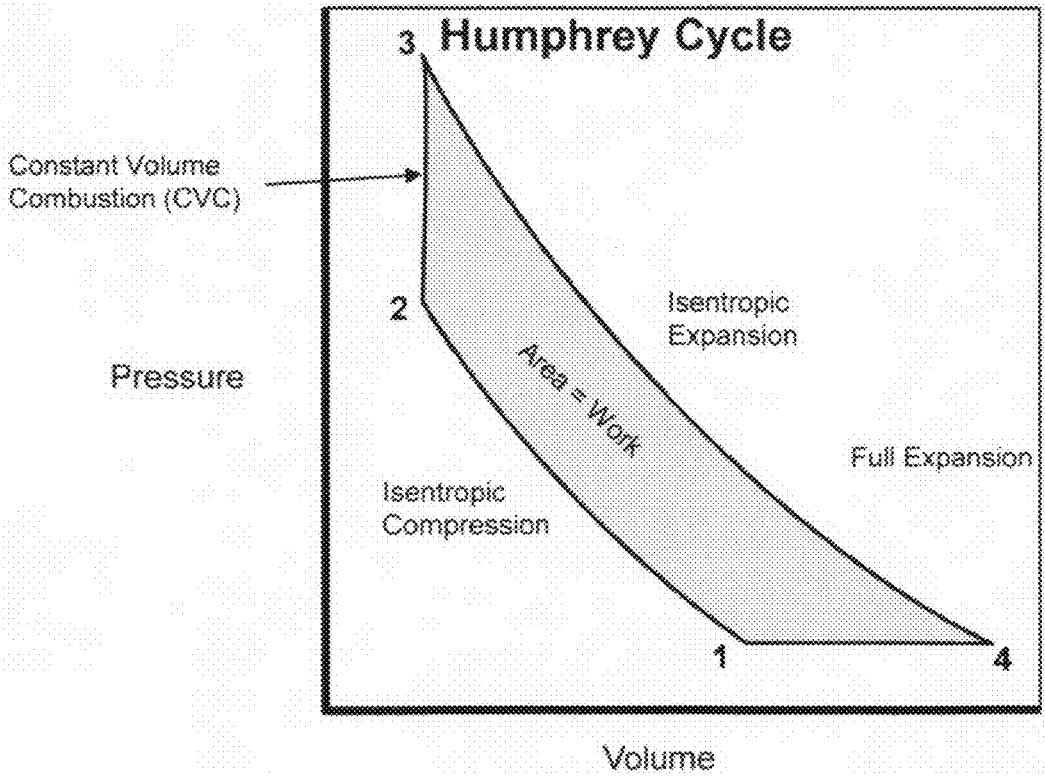

Prior to zones 45 and 46 reaching the exhaust annulus and approximately 15° in the orbital rotation past the spiral band innermost tips contacting the wall of the other spiral band, a pair of recesses 49 in the fixed spiral band wall as seen in FIG. 7*c* to 7*d* represent the location of the source of ignition located within the combustor head plate 11 and exposed in a flame cavity 48 of the fixed scroll plate, as can be seen in FIG. 8. Once the orbital rotation of the orbital scroll plate 13 moves the isolated crescent shaped zones far enough along their radially outward path within the scroll combustor 43 to expose the ignition source 19, the fluid is combusted, FIG. 7*d*. Because the zones are isolated from the intake chamber prior to ignition, the ignition source does not need to be timed and therefore can be continuous. FIG. 7*e* depicts the combusted mixture moving to the outer periphery of the scroll combustor 43 and being exhausted out the combustor exhaust port 48 as can be seen in FIG. 3.

The configuration of the scroll combustor 43 with an ignition source 19 located in one or more zones that are isolated from the compressor outlet 36 or combustor intake chamber 15 by the contact points of the spiral bands within the combustor scroll 43 makes possible a nearly constant volume combustion of the compressed fluid and creates a thermodynamic efficiency similar to a Humphrey cycle machine.

Once the fluid is combusted within the isolated crescent shaped zone there is a rapid increase in both temperature and pressure within those zones 45 and 46 of the combustor scroll 43. The rapid increase in pressure is felt on the spiral bands of the combustor as the gas expands into the walls of the zones creating a force within the scroll combustor that is translated to torque upon the orbital shaft 29 that then contributes to the orbital motion of the orbital shaft 29 which further enables the compression of fluid within the compressor scroll 86. Excess torque being translated to the main sprocket 27 for additional work output.

In one embodiment of the machine, the ignition source is a spark plug 19 placed in the wall of the combustor head plate 11. The spark point of the spark plug is located within a flame cavity 48 slightly recessed in said fixed orbital face plate 14 and partially recessed 49 within the wall of the fixed spiral band 41, See FIG. 8. The location of the ignition sources are strategic in that the ignition source: is isolated from the intake chamber 15 at all degrees of orbital rotation; enables the sparking source to continuously spark and not be dependent on a specific timing sequence with respect to the orbital rotation; and provides a means for sparking both of the crescent shaped zones within the scroll combustor. It should be noted that by placing the flame cavity 48 at a point where the fixed spiral band 41 is partially recessed and by using a diameter on the flame cavity that is smaller than the thickness of the wall of the orbital spiral band 42, the ignition source is never exposed to the intake chamber 15.

By having the ignition source slightly recessed into the flame cavity 48 of the fixed scroll plate 14, combustible fuel once ignited is able to remain within the cavity supplying another source of ignition within the isolated zones of the scroll combustor. Additionally, the recesses within the wall of the spiral band of the fixed orbital plate promote the ability of the isolated zones to combust by creating small areas of turbulence which enhances the flame holding capability and combustion process when the ignition source is exposed to the combustible mixture and the scroll zone is expanded.

Another means for supplying an ignition source to an operating machine is to introduce a back flame to the isolated combustible mixture. Back flame is combusting mixture that is further along in the scroll combustor at a zone that is in front of a newly isolated zone within the scroll combustor. A small hole or several small holes can be placed within the spiral bands at a location further along from the flame cavity 47 permitting a very small back flame to leak back into the newly isolated zone supplying another means for igniting the combustible material.

Another aspect of this design is the ability to introduce one or more combustible mixture components at a location other than the intake chamber 15 of the scroll combustor 43. This is advantageous when alternative fuels are necessary for operations in which the machine is not readily able to use the surrounding air as a combustible component, like in space or at high altitudes. For example, one or more components of a combustible mixture might be injected directly into said isolated zones of the scroll combustor with the other components of the combustible mixture being introduced through the compressor prior to delivery into the inlet chamber 15. The combustible mixture will then mix and be exposed to an ignition source within the scroll combustor.

Another embodiment includes compressing one or more components of the combustible mixture within the compressor and delivering the compressed mixture to the hollow shaft wherein the rest of the components of the combustible mixture are introduced and the combustible mixture mixes prior to being delivered to the inlet chamber of the scroll combustor.

It should also be noted that the shape of the spiral bands 45 and 46 used in the combustor need not be based on the arc created by the involute of a circle and can be created with other dimensions as long as the bands are able to effectively create discrete volumes or zones during the orbiting of the scroll, see U.S. Pat. No. 6,220,840, Calhoun, John (2001).

By manipulating the dimension or configuration of the spiral bands the rotary positive displacement combustor can be made to produce either a hot-high pressure exhaust (thrust), shaft power, or a combination of hot-high pressure exhaust and shaft power. By creating short and tight radial orbits of the isolated zones, the combusted mixture will have a relatively short travel to exhaust—producing a hot-high temperature exhaust. By using longer spiral bands within the scroll, the combustion and expansion produced within the scroll combustor will generate additional shaft power and less thrust.

Another means of manipulating the amount of work produced by the scroll combustor is by adjusting the size of the isolated zones within the scroll combustor. By increasing the depth of the spiral bands 41 and 42 on the fixed and orbital scroll face plates 14 and 13, the volume of the isolated zones is increased—this allows for greater capture of combustible material and additional energy released within the zone during combustion and expansion.

One benefit, of using a scroll compressor, orbital assembly and scroll combustor is the simplicity associated with physically balancing the device and reducing vibration and noise. The symmetrical nature of the scroll combustor coupled with the scroll compressor allows for an easier process to balance the machine to reduce vibration. The machine, by using orbital or rotational parts, has relatively little vibration compared to machines that use cylinder and pistons in a combustion cycle.

In the preferred embodiment, the device strategically places the ignition source in a location within the scroll combustor 43 that is isolated from the intake chamber 15. By isolating the ignition from the intake chamber, the combustion of discrete packages or volumes of combustible material can be controlled allowing for complete combustion of the combustible mixture using a variety of fuel types. This allows the engine to be incorporated into a variety of applications and able to exploit a wide variety of fuel sources with little or no manipulation of the basic engine design.

We claim:

1. An engine comprising:

a combustor assembly having first and second spiral bands configured to engage with one another to provide a first zone to transfer fluid outward in a radial direction from an intake chamber of the combustor assembly upon movement of the first spiral band with respect to the second spiral band; and an ignition source configured to combust fluid in the first zone;

a compressor assembly having third and fourth spiral bands configured to engage with one another to provide a second zone to transfer fluid inwardly in a radial direction to an outlet chamber of the compressor assembly upon movement of the third spiral band with respect to the fourth spiral band; and a shaft assembly coupled with the combustor assembly and the compressor assembly and having a barrel shaft and an orbital shaft, located within the barrel shaft and coupled with the barrel shaft in a manner to facilitate relative movement between the orbital shaft and the barrel shaft, the orbital shaft to transfer fluid from the outlet chamber to the intake chamber, wherein combustion of fluid in the first zone facilitates orbital rotation of the orbital shaft within the barrel shaft, which, in turn, facilitates said transfer of fluid inwardly to the outlet chamber of the compressor assembly.

2. The engine of claim 1, wherein the combustor assembly includes:

a first scroll plate with a first center aperture, adjacent to the intake chamber, and the first spiral band axially mounted to a first face side of the first scroll plate and the orbital shaft coupled with a second face side of the first scroll plate; and a second scroll plate with the second spiral band axially mounted to a third face side of the second scroll plate.

3. The engine of claim 2, wherein the orbital shaft is connected with the second face side.

4. The engine of claim 2, wherein the compressor assembly includes:

a third scroll plate with a second center aperture, adjacent to the outlet chamber, and the third spiral band axially mounted to a fourth face side of the third scroll plate and the orbital shaft coupled with a fifth face side of the third scroll plate; and a fourth scroll plate with the fourth spiral band axially mounted to a sixth face side of the fourth scroll plate.

5. The engine of claim 4, wherein the orbital shaft is connected with the fifth face side.

6. The engine of claim 2 wherein the ignition source is disposed within a cavity of the plate of the combustor assembly, the cavity having a diameter that is less than a thickness of a wall of the first spiral band.

7. The engine of claim 2, further comprising a plurality of orbital thrust bearings configured to restrict movement of the first scroll plate to an orbital movement of translation and to prevent the first scroll plate from rotating.

8. The engine of claim 1, wherein the ignition source is recessed within a cavity of a plate of the combustor assembly.

9. The engine of claim 1, wherein the first and second spiral bands are further configured to engage with one another to provide a second zone to transfer fluid outward in a radial direction from the intake chamber upon movement of the first spiral band with respect to the second spiral band, and the combustor assembly further comprises:

another ignition source configured to combust fluid in the second zone simultaneously with combustion of fluid in the first zone.

10. The engine of claim 1, wherein the shaft assembly further comprises:

an internal counterweight located within and coupled with the barrel shaft, wherein the orbital shaft is coupled with the internal counterweight by an orbital link and link pin.

11. The engine of claim 10, wherein the orbital shaft is disposed within the orbital link and is supported by a plurality of bearings.

12. The engine of claim 1, wherein the shaft assembly further comprises a plurality of barrel shaft bearings configured to support the barrel shaft.

13. The engine of claim 1, wherein the orbital shaft is coupled with the barrel shaft in a manner such that rotation of the barrel shaft displaces the orbital shaft in a circular movement of translation.

14. The engine of claim 1, wherein the ignition source is further configured to combust fluid in the first zone when the first zone is isolated from the intake chamber.

* * * * *